United States Patent [19]

Harper

[11] 4,323,868

[45] Apr. 6, 1982

[54] SETTING MECHANISM FOR SNAP ACTION CIRCUIT BREAKER

[75] Inventor: George S. Harper, Cambridge, Md.

[73] Assignee: North American Philips Controls Corp., Cambridge, Md.

[21] Appl. No.: 198,190

[22] Filed: Oct. 17, 1980

[51] Int. Cl.[3] ..... H01H 75/10; H01H 5/00

[52] U.S. Cl. ..... 335/38; 335/188; 335/174; 337/66

[58] Field of Search ..... 335/38, 35, 43, 23, 335/14, 17, 164, 165, 166, 174; 337/66

[56] References Cited

U.S. PATENT DOCUMENTS

| | | | |
|---|---|---|---|
| 3,706,057 | 12/1972 | Ellenberger | 337/66 |
| 3,806,848 | 4/1974 | Harper et al. | 335/188 |
| 4,117,285 | 9/1978 | Harper | 335/188 |

*Primary Examiner*—Harold Broome
*Attorney, Agent, or Firm*—Saidman & Sterne

[57] ABSTRACT

A circuit breaker comprising an electrically insulating housing, an overcurrent sensor in the housing, a stationary and a movable contact in the housing, and a latch mechanism coupled to the movable contact. The latch mechanism is tripped in response to a sensed overcurrent; an overcenter spring is coupled to the movable contact for opening and closing the contacts with a snap action when the latch mechanism is tripped. An elongated handle member extends through a handle opening in the housing and is movable axially between a contacts open position and a contacts closed position. Handle link means couples the handle member to the latch mechanism and translates a longitudinal movement of the handle member into a rotational movement of the handle link to urge the latch mechanism into the contacts closed position. The handle link means is also operable to retain the handle member in its second position upon manual movement of the handle member from its first to its second position and for permitting tripping of the latch mechanism and opening of the contacts independently of movement of the handle member. The handle member also has means associated therewith to inhibit rotational movement of the handle member while permitting longitudinal movement.

9 Claims, 10 Drawing Figures

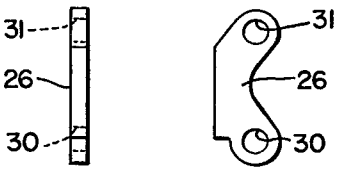
Fig.4A
Fig.4B
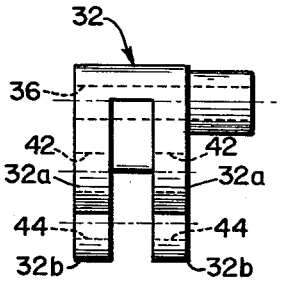
Fig.3B
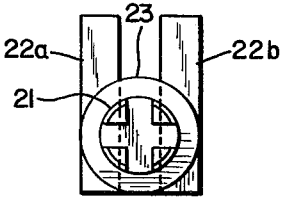
Fig.5B
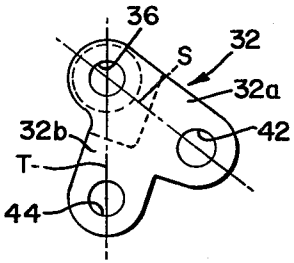
Fig.3A
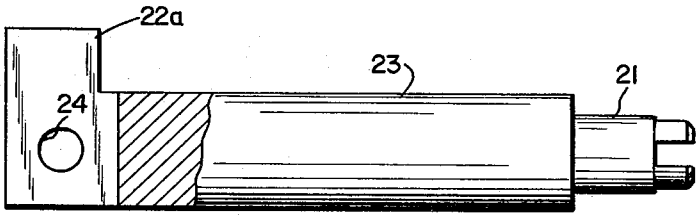
Fig.5A
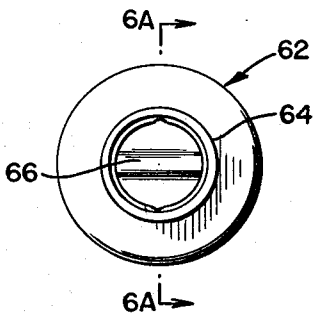
Fig.6B
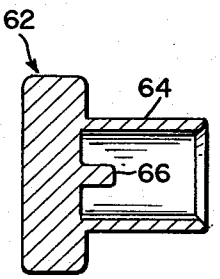
Fig.6A

SETTING MECHANISM FOR SNAP ACTION CIRCUIT BREAKER

BACKGROUND OF THE INVENTION

This invention relates to snap action magnetic circuit breakers. More particularly, the invention relates to improved circuit breaker mechanisms for use in compact snap action breakers combining the functions of switches and circuit breakers.

Compact snap action circuit breakers are disclosed in commonly assigned U.S. Pat. No. 3,806,848 issued Apr. 23, 1974 to George S. Harper et al. (the '806 patent) and U.S. Pat. No. 4,117,285 issued Sept. 26, 1978 to George S. Harper (the '285 patent). In the devices described in the '806 and '285 patents, a toggle mechanism is tripped by the attraction of an armature to an electromagnet when the current through the electromagnet coil exceeds a predetermined value.

A movable contact of the circuit breaker is coupled to an overcenter spring so that upon tripping, the contacts open with a positive snap action to minimize contact arcing. The overcenter spring also acts on the movable contact when the circuit breaker contacts are open or closed manually. This snap action opening and closing of the circuit breaker contacts during manual operation has the advantage that it makes it impossible for the contacts to be "teased" in such a way as to damage the circuit breaker.

The handle mechanisms described in the '848 and '285 patent are of the toggle, rocker-arm, or push-push (push on-push off) type. While these handle mechanisms are appropriate for certain types of operations, other operations require a push-pull switch handle mechanism. Still other operations require a mechanism which can be manually operated to set the breaker in its contact closed position but prevents manual opening of the breaker contacts.

Snap action circuit breakers of the type to which this invention is directed are frequently incorporated into control panels or like structures in which numerous breakers are mounted in banks aligned in rows and columns. For example, computer manufacturers will often incorporate a circuit breaker into each separate power supply line to prevent electrical problems in one section of the computer from spilling over and affecting other sections. Often in large scale computer installations, fifty to one hundred or more circuit breakers may be utilized. Normally, the circuit breakers will be located in one cabinet in banks. It is desirable to provide a quick visual means for determining which breaker(s) among the fifty to one hundred or more located in a cabinet has tripped due to an electrical overload. The push-pull type of breaker handle mechanism of the present invention provides such a quick means for visually isolating the tripped breaker without requiring the use of additional electrical circuits using bulb type indicators which can burn out but which also maintain the manual opening capability of the breaker assembly.

Other types of installation require a breaker mechanism which cannot be manually tripped open. In the medical electronics field, for example, it is desirable to use circuit breakers in sophisticated electronic monitoring and/or life support equipment. It will be apparent that, in the operation of such equipment, the inadvertant manual opening of circuit-breakers could have severe adverse or disasterous consequences. It is therefore desirable to provide a switch-breaker mechanism which cannot be inadvertantly manually tripped. It is also desirable to provide a breaker mechanism having the same quick visual contacts open recognition feature described above. In one embodiment, this invention provides such a breaker.

The present invention, described with respect to the appended drawing and the detailed description of the preferred embodiments below, provides new and improved handle mechanisms consistent with the aforedescribed operating requirements. Specifically, one embodiment of this invention provides a push to close breaker setting mechanism which cannot be manually triggered into the contacts open position; a second embodiment of the invention provides a push to close, pull to open operating mechanism having the features of a push-pull manually operated switch with the overcurrent protection action of a circuit breaker. Other features and advantages of this invention will be apparent from the following description of the preferred embodiments.

SUMMARY OF THE INVENTION

The handle or setting mechanism of the present invention is preferably used in combination with a magnetic circuit breaker having and electrically insulating housing, an overcurrent sensor in the housing, a stationary and movable contact, a latch mechanism coupled to the movable contact and some means for tripping the latch mechanism in response to a sensed overcurrent. Upon tripping the latch mechanism, the movable contact snaps open under the influence of an overcenter spring device. The circuit breaker has an elongated handle member which extends through a handle opening in the breaker housing. The handle member is movable longitudinally between a "set" or contacts open position and a "reset" or contacts closed position; means are provided to prevent rotational movement of the handle member. Handle link means couple the handle member to the latch mechanism; the handle link means is operative to translate a substantially linear movement of the handle member into a rotational movement of the link means for urging the latch mechanism into its contacts closed position. The handle link means is operative to retain the handle member in its reset position upon manual movement thereof from its set to its reset positions. Means are also provided to bias the handle member toward its contacts open position when the latch mechanism is tripped.

In one embodiment, the top of the handle member lies flush with the top of the handle opening in the breaker housing in its contacts closed or reset position. In another embodiment, the handle member is constructed with a button on the end to permit manual opening and to permit orienting the button in one of a plurality of ways so that proper orientation of indicia stamped on the face of the button can be maintained irrespective of the orientation of the breaker in its mounting arrangement.

BRIEF DESCRIPTION OF THE DRAWING

FIGS. 3A-B show the second handle link member of this invention in side and end views, respectively;

FIGS. 4A-B show the first handle link member in side and end views, respectively;

FIGS. 5A-B show a part sectional side view and end view respectively, of one embodiment of the handle member and;

FIGS. 6A-B show a side sectional and end view, respectively, of the cap member used in combination with the handle member shown in FIGS. 5A-B.

DESCRIPTION OF THE PREFERRED EMBODIMENT

The switch handle mechanisms of this invention were developed for use with a snap action circuit breaker mechanism of the type described in my above-mentioned U.S. Pat. No. 4,117,285. The disclosure of said '285 patent is incorporated in its entirety herein by reference thereto, with particular reference being made to the snap action mechanism and housing described therein and shown in FIGS. 1–22 thereof.

Figure 1:
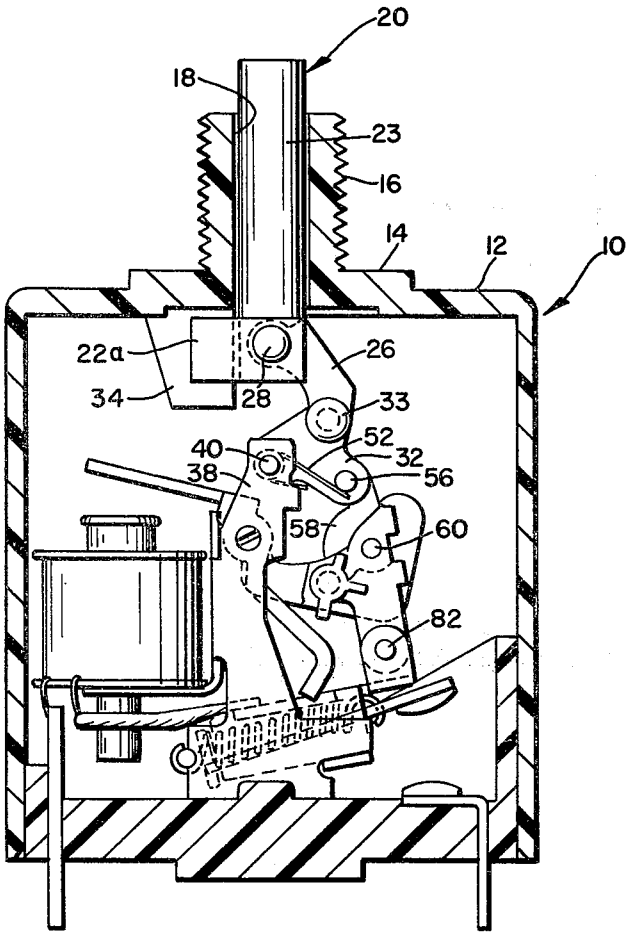
FIG. 1 is a cut-away side view of the snap action circuit breaker housing showing the breaker mechanism and handle mechanism of this invention in a contacts open position.

FIG. 1 herein shows a snap action circuit breaker incorporating an embodiment of the handle mechanism of this invention in the contacts open position. The circuit breaker mechanism, the details of which are described in the aforementioned '285 patent, is contained in an insulated housing 10, generally of plastic material or the like. The top face 12 of the housing contains a bushing 14 and a threaded boss 16. A handle opening 18 is formed through boss 16 and bushing 14 to accommodate an elongated handle member 20.

A pair of substantially parallel flange members 22*a*, 22*b*, extend outwardly from the main body 23 of push button handle member 20 at its lower end. An opening 24 passes through handle 20. Preferrably and advantageously, opening 24 passes through the portion of handle 20 including the flange members 22*a*, 22*b* so that the center of through opening 24 intersects the longitudinal axis of handle 20.

A first handle link member 26 is connected to handle 20 at one end by a pivot pin 28 passing through opening 24 and a corresponding opening 20 in handle link 26. The other end of first handle link member 26 has an opening 31; a pivot pin 33 passes through opening 31 to pivotably connect handle link 26 to one arm of a second handle link member 32, as will be described below.

Figure 2:
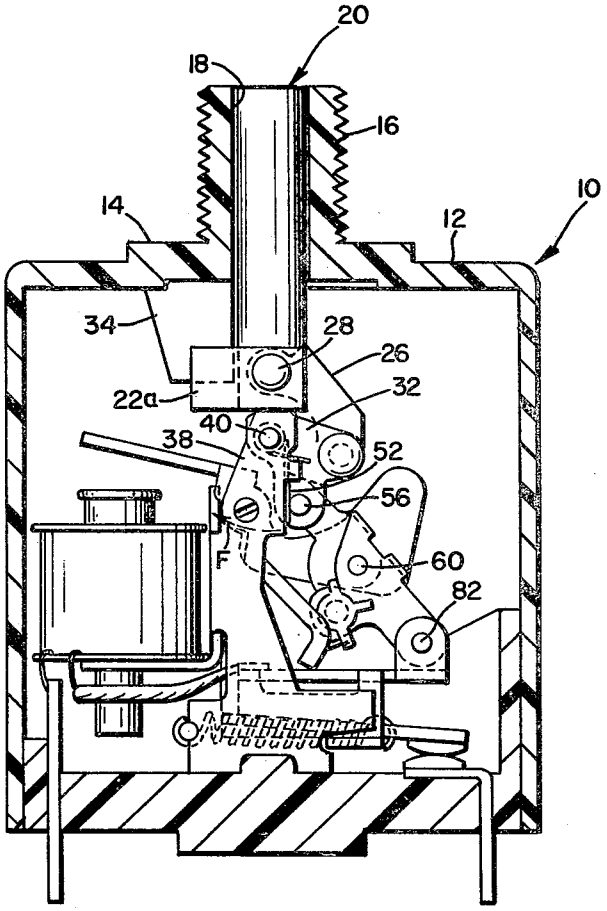
FIG. 2 is a cut-away view of the breaker housing showing the breaker mechanism and handle mechanism in the contacts closed position.

A generally flat guide flange or rail 34 extends downwardly from the top of housing 10 adjacent the inner end of handle opening 18. As shown in FIGS. 1 and 2, flange members 22*a* and 22*b* extend on opposite sides of guide rail 34 and act as stops to inhibit rotational movement of the handle member 20. Among other features, this prevents undue torsional forces from being imparted to the handle link members 26 and 32 and through them to the breaker latch mechanism. The latch mechanism and snap action contact mechanism are described in more detail in the '848 and '285 patents.

The second handle link member 32 is shown in detail in FIGS. 3A and 3B. The handle link 32 contains a first through opening 36 for pivotably mounting handle link 32 to the main breaker frame 38 by means of a pivot rod 40 extending through opening 36 to the opposite side members of frame 38. A second pivot opening 42 is located adjacent to the end portion of one arm 32*a* of link member 32; and a third pivot opening 44 is located adjacent to the end portion of a second arm 32*b* of link member 32. Preferably, member 32 is bifurcated so that each arm 32*a* and 32*b* consists of a pair of parallel arms as shown in FIG. 3B.

A cam link member 58, comprising part of the latch mechanism, extends between the parallel arms 32*b* and is pivotably connected to link member 32 by a pivot pin 56 extending through the aligned openings 44 in cam link 58. Similarly, the first handle member 26 extends between the parallel arms 32*a* and is pivotably connected thereto by pivot pin 33 extending through opening 31 in handle link 26 and through corresponding openings 44 in each of the parallel arm segments 32*b*.

Arms 32*a* and 32*b* of handle link member 32 bear a preferable and operationally advantageous relationship to each other. Referring to FIG. 3A, a first straight line S intersecting the centers of pivot openings 36 and 42 and a second straight line T intersecting the centers of pivot openings 36 and 44 define therebetween an angle $\theta$. Preferably $\theta$ lies between 45° and 90°; more preferably, angle $\theta$ lies between 50° and 55°; in one preferred embodiment, $\theta$ is approximately 52°.

Further, the length of arm 32*b*, and particularly the distance between the centers of pivot openings 36 and 44, must be sufficient to move the latching mechanism and the movable carrier downwardly against the action of the overcenter spring a distance sufficient to force the movable carrier and movable contact blade beyond the center plane of the spring. Such movement causes the contacts opening force to become a closing force, and the movable contact snaps closed against the stationary contact.

A further feature of the invention is that the length of travel of the handle member 20 must be sufficient to permit rotation of handle link member 32 to its locking position. This occurs when the handle link member 32 moves (a) from the position shown in FIG. 1, (b) through the position wherein the pivot point 56 (between the latch mechanism and handle link 32) and the further latch mechanism pivot points 60 and 82 are aligned in a straight line and (c) around to the position shown in FIG. 2, with the resultant of rotational forces being in the direction of arrow F. In this position, pivot pin 56 butts up against frame 38 to prevent further rotation of link member 32.

Tripping of the latch mechanism occurs in accord with the operation described in the forementioned '848 patent; the disclosure of the '848 patent is incorporated herein in its entirety by reference. When the breaker is tripped, the latch mechanism moves so as to rotate handle link member 32 in the direction opposite arrow F (counterclockwise with respect to the orientation of FIGS. 1 and 2). Counterclockwise rotation of handle link member 32 is translated into a longitudinal movement of handle member 20 by handle link member 26, causing handle member 20 to move upward into its "set" or contacts open position under the biasing force exerted by a spring member 52. Advantageously, spring 52 is coiled around pivot pin 40 and has an extending arm which reacts against pivot pin 56.

In one embodiment, handle member 20 is of a length such that in the "reset" or contacts closed position (FIG. 2), the top of the handle member is flush with the top of boss 16. This arrangement prevents inadvertant manual opening of the breaker contact in those situations where such inadvertant opening could have detrimental effects, as in medical electronic applications.

In a second embodiment, shown in FIGS. 5A-B and 6A-B, the handle member 20 has an extended portion 21 of reduced diameter which is slotted at right angles at its end. A cap member 62 has an axial sleeve 64 which slides over reduced diameter portion 21 or handle member 20. A spar 66 mates with one or the other of the crossed slots. This permits the button 62 to be oriented in one of four discrete orientations depending on how the breaker is to be mounted (vertically or horizontally) in a breaker panel. This is advantageous in that it permits writing (e.g. breaker current rating indicia) which is normally embossed on the top face of the button 62 to be properly oriented for ease of reading.

The embodiment incorporating the handle member shown in FIGS. 5 and 6 permits the circuit breaker to be manually set (or opened) and reset (or closed) in a "pull to set" and "push to reset" mode of operation.

It is apparent from the foregoing that the present invention provides improved circuit breaker handle mechanism constructions in combination with a snap action switch feature. The circuit breaker of this invention combines, in one embodiment, a push button type of magnetic snap action breaker with the capacity for preventing inadvertant manual opening; a second embodiment of the invention provides a push-pull switch type of magnetic snap action breaker, having the feel of a push-pull switch with the automatic tripping capability of a breaker. The circuit breakers of this invention can therefore be used in situations requiring push-pull switches with overcurrent protection and in situations requiring push button breakers in which it is necessary to prevent manual tripping.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

What is claimed is:

1. A circuit breaker comprising an electrically insulating housing; an overcurrent sensor in said housing; a stationary and a movable contact in said housing; a latch mechanism coupled to said movable contact, and means for tripping said latch mechanism in response to a sensed overcurrent and for moving said latch mechanism between contacts open and contacts closed positions; means, including an overcenter spring, coupled to said movable contact for opening and closing said contacts with a snap action; a handle opening in said housing; an elongated handle member extending through said handle opening; means for permitting longitudinal axial movement of said handle member while inhibiting rotational movement thereof between a first, contacts open position and a second, contacts closed position; handle link means coupling said handle member to said latch mechanism, said handle link means being operative to translate a substantially linear movement of said handle member into a rotational movement of said link means for urging said latch mechanism into said contacts closed position, said handle link means being operable to retain said handle member in its second position upon manual movement of the handle member from its first to its second position and for permitting tripping of said latch mechanism and opening of said contacts independently of movement of said handle member; and means normally biasing said handle member toward said first, contacts open position when said latch mechanism is tripped by said overcurrent sensor.

2. A circuit breaker according to claim 1, further comprising a flat guide rail extending downwardly from the inner top face of the housing adjacent said handle opening, said handle having means thereon which cooperate with said flat guide member to take up rotational torsion forces inparted to said elongated handle member.

3. A circuit breaker according to claim 2, wherein said handle member comprises an elongated rod which is slotted at one end to pivotably mount said handle link means, and a pair of flat parallel flange members extending from said rod opposite sides of and adjacent to said guide rail, the space between said flange members being slightly greater than the thickness of said guide rails to permit free longitudinal movement of said flanges and said rod along the length of said rail, one of said flanges engaging said rail when a rotational or twisting force is exerted on said handle rod.

4. A circuit breaker according to claim 1 or 3, wherein said handle link means comprises a first member coupled to said latch mechanism through a first pivot mount and to said frame at a second pivot mount, and a second member pivotably coupled at one end to said elongated handle member and at its other end to a third pivot mount intermediate said first and second pivot mounts.

5. A circuit breaker according to claim 4, wherein the angle subtended by the arc bounded on one side by a first straight line through the center of said first and second pivot points and on the other side by a second straight line through the centers of the second and third pivot points is less than 90°.

6. A circuit breaker according to claim 5, wherein said angle is greater than 45°.

7. A circuit breaker according to claim 6, wherein said angle is less than 55°.

8. A circuit breaker according to claim 1 or 3, wherein said handle member has a flanged extension at its outer end portion to permit manually grasping said handle member for manually moving said member to its contacts open position.

9. A circuit breaker according to claim 1 or 3, wherein the top of said handle member lies flush with said handle openings in said contacts closed position and extends outwardly from said opening in the contacts open position.

* * * * *